US011133137B2

(12) United States Patent
Ota et al.

(10) Patent No.: US 11,133,137 B2
(45) Date of Patent: Sep. 28, 2021

(54) OPERATION DEVICE

(71) Applicants: DENSO CORPORATION, Kariya (JP); TOYOTA JIDOSHA KABUSHIKI KAISHA, Toyota (JP)

(72) Inventors: Yukihide Ota, Kariya (JP); Hiromune Wada, Kariya (JP); Toshinori Aoki, Toyota (JP); Takaaki Koyama, Okazaki (JP); Masahiro Kasai, Miyoshi (JP)

(73) Assignees: DENSO CORPORATION, Kariya (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/792,459

(22) Filed: Feb. 17, 2020

(65) Prior Publication Data

US 2020/0185170 A1 Jun. 11, 2020

Related U.S. Application Data

(63) Continuation of application No. PCT/JP2018/032569, filed on Sep. 3, 2018.

(30) Foreign Application Priority Data

Sep. 28, 2017 (JP) ..... JP2017-188100

(51) Int. Cl.
*H01H 19/02* (2006.01)
*H01H 19/11* (2006.01)

(52) U.S. Cl.
CPC ..... *H01H 19/025* (2013.01); *H01H 19/11* (2013.01); *H01H 2219/062* (2013.01)

(58) Field of Classification Search
CPC ..... H01H 19/025; H01H 19/11; H01H 2219/062; H01H 2219/06; H01H 19/001; H01H 2019/146; H01H 19/10; H01H 13/83; H01H 13/023; H01H 2219/036; H01H 2219/056; H01H 2221/07; H01H 2219/064; H01H 9/161; H01H 9/182;
(Continued)

(56) References Cited

U.S. PATENT DOCUMENTS

2004/0051392 A1* 3/2004 Badarneh ..... G06F 3/0362 307/112
2014/0315510 A1* 10/2014 Heng ..... F21V 33/0056 455/347

(Continued)

FOREIGN PATENT DOCUMENTS

JP 2007165213 A 6/2007

*Primary Examiner* — Ahmed M Saeed
(74) *Attorney, Agent, or Firm* — Harness, Dickey & Pierce, P.L.C.

(57) ABSTRACT

An operation device includes a scroll wheel, a portion of which projects from an opening of an operation surface. The scroll wheel is configured to be rotated by an operator. The scroll wheel includes a ring member that is formed by a light transmissive member, which is configured to transmit light. The operation device includes: a light source that is configured to generate light for nighttime illumination; a wheel illumination light guide member that is configured to guide the light, which is outputted from the light source, to the scroll wheel; and a metal film that is formed at an inner peripheral surface of the ring member.

5 Claims, 15 Drawing Sheets

(58) Field of Classification Search
CPC ..... H01H 2219/0622; H01H 2009/164; H01H 21/025; G06F 3/03543; G06F 3/0362; G06F 3/0312; G06F 3/0317; G06F 2203/0337; G06F 3/0202; G06F 3/033; G06F 1/3215; G06F 3/016; G06F 3/0213; G06F 3/0227; G06F 3/0304; G06F 3/0338; G06F 3/038; G06F 3/0383; G06F 3/0485
See application file for complete search history.

(56) References Cited

U.S. PATENT DOCUMENTS

| | | | | |
|---|---|---|---|---|
| 2015/0034463 | A1* | 2/2015 | Breich | H01H 19/025 200/17 R |
| 2018/0130628 | A1* | 5/2018 | Udo | H01H 89/00 |
| 2018/0364817 | A1* | 12/2018 | Ota | B60K 37/06 |

* cited by examiner

OPERATION DEVICE

CROSS REFERENCE TO RELATED APPLICATIONS

This application is a continuation application of International Patent Application No. PCT/JP2018/032569 filed on Sep. 3, 2018, which designated the U.S. and claims the benefit of priority from Japanese Patent Application No. 2017-188100 filed on Sep. 28, 2017. The entire disclosures of all of the above applications are incorporated herein by reference.

TECHNICAL FIELD

The present disclosure relates to an operation device that includes a scroll wheel.

BACKGROUND

There has been proposed an operation device, which includes a scroll wheel that can be manually rotated. This scroll wheel is made of a transparent member, and a metal film is vapor deposited on an outer peripheral surface of the scroll wheel so as to be a half mirror. Therefore, in the daytime, a level of design of the scroll wheel is increased by the beautiful appearance of the metal film. Furthermore, in this device, at the nighttime, light from a light source is guided to the scroll wheel and is transmitted through the metal film, so that the scroll wheel is illuminated, and thereby a level of nighttime design of the scroll wheel is increased.

SUMMARY

This section provides a general summary of the disclosure, and is not a comprehensive disclosure of its full scope or all of its features.

According to the present disclosure, there is provided an operation device that includes: a scroll wheel that includes a ring member formed by a light transmissive member; a light source that is configured to generate light; a wheel illumination light guide member that is configured to guide the light, which is outputted from the light source, to the scroll wheel; and a metal film that is formed at an inner peripheral surface of the ring member.

BRIEF DESCRIPTION OF DRAWINGS

The drawings described herein are for illustrative purposes only of the selected embodiment and not all possible implementations, and are not intended to limit the scope of the present disclosure.

DETAILED DESCRIPTION

Figure 1:
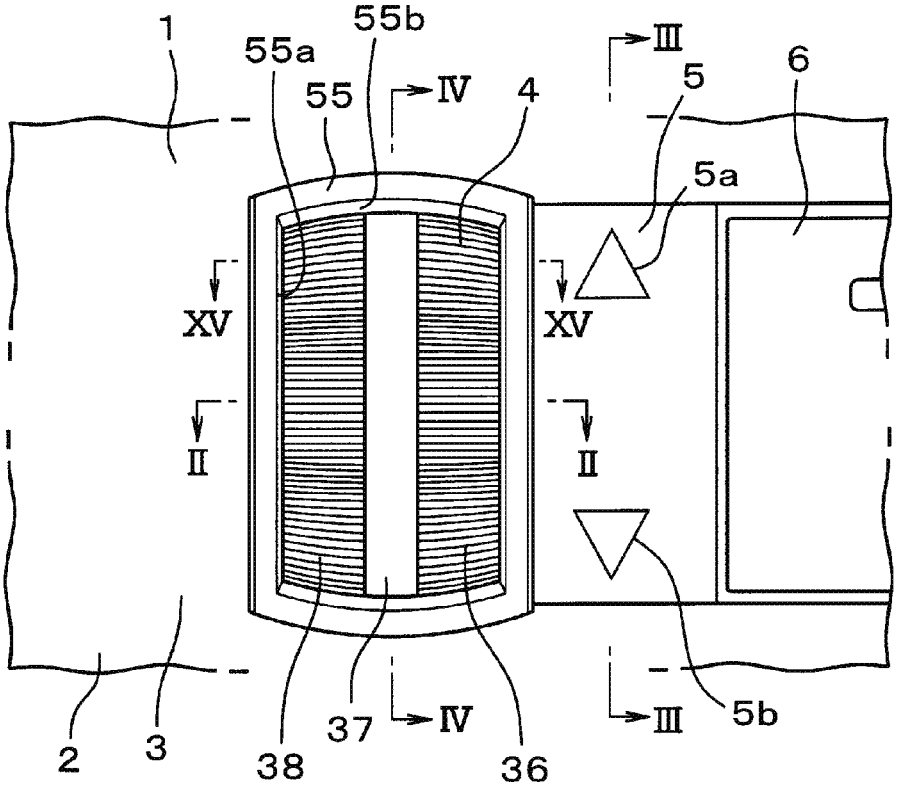
FIG. 1 is a front view of an operation device according to an embodiment.

There has been proposed an operation device, which includes a scroll wheel that can be manually rotated. This scroll wheel is made of a transparent member, and a metal film is vapor deposited on an outer peripheral surface of the scroll wheel so as to be a half mirror. Therefore, in the daytime, a level of design of the scroll wheel is increased by the beautiful appearance of the metal film. Furthermore, in this device, at the nighttime, light from a light source is guided to the scroll wheel and is transmitted through the metal film, so that the scroll wheel is illuminated, and thereby a level of nighttime design of the scroll wheel is increased.

However, with the above configuration, when a level of appearance of the deposited metal film, which forms the half mirror, is increased, i.e., when a level of daytime design of the scroll wheel is increased, the light transmissivity of the metal film is lowered, and thereby the luminance is lowered, that is, a level of nighttime design is lowered. On the other hand, when the light transmissivity of the metal film is increased to increase the luminance, i.e., when the level of nighttime design is increased, the appearance of the metal film is deteriorated, that is, the level of daytime design is lowered.

With respect to the above point, it is conceivable to provide a structure, in which the light is emitted from a gap between the scroll wheel and an opening of the operation panel to illuminate the gap, and thereby both the level of daytime design and the level of nighttime design of the scroll wheel are improved. However, in the case of this structure, there is a disadvantage of that the appearance, such as the brightness of light, changes depending on a viewing angle of a user, and/or it is difficult to shine uniformly at upper and lower sides of the scroll wheel.

According to one aspect of the present disclosure, there is provided an operation device including: a scroll wheel, a portion of which projects from an opening formed at an operation surface, wherein the scroll wheel is configured to be rotated by an operator, and the scroll wheel includes a ring member that is formed by a light transmissive member, which is configured to transmit light; a light source that is configured to generate the light for nighttime illumination; a wheel illumination light guide member that is configured to guide the light, which is outputted from the light source, to the scroll wheel; and a metal film that is formed at an inner peripheral surface of the ring member.

Hereinafter, an embodiment will be described with reference to FIGS. 1 to 17. An operation device 1 of the present embodiment is a device that is configured to change (to input) a set value of a predetermined control parameter at, for example, an air conditioner of a vehicle and is installed at a center console of the vehicle. Here, the operation device 1 is configured to change, for example, the setting of the temperature of the conditioning air, which serves as the predetermined control parameter.

Figure 2:
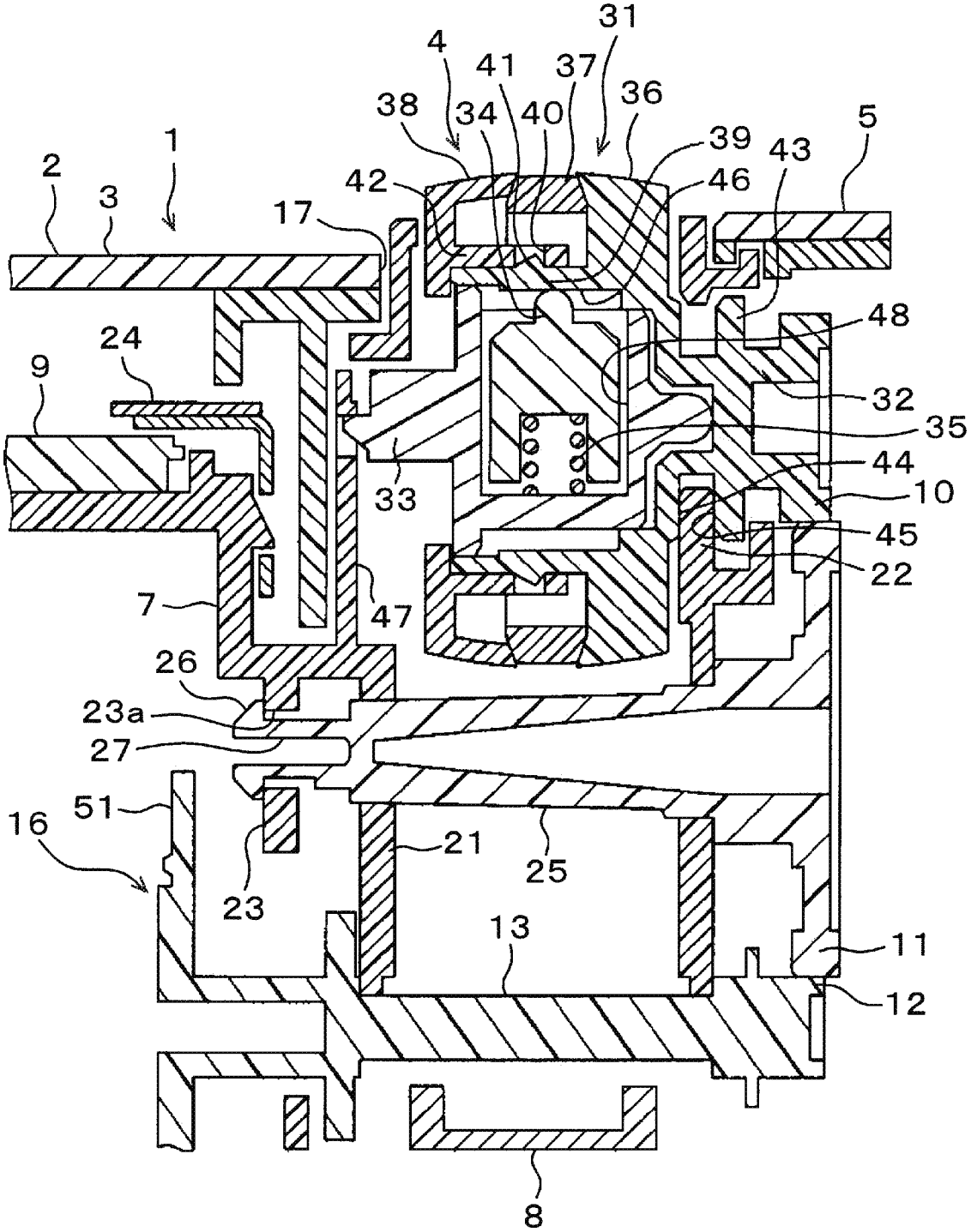
FIG. 2 is a cross-sectional view taken along line II-II in FIG. 1.

As shown in FIG. 1, a scroll wheel 4, a rotational direction indicator 5 and a switch device 6 are placed at an operation surface 3 of a casing 2 of the operation device 1. FIG. 2 is a cross-sectional view taken along line II-II in FIG. 1, and FIG. 3 is a cross-sectional view taken along line III-Ill in FIG. 1.

Figure 3:
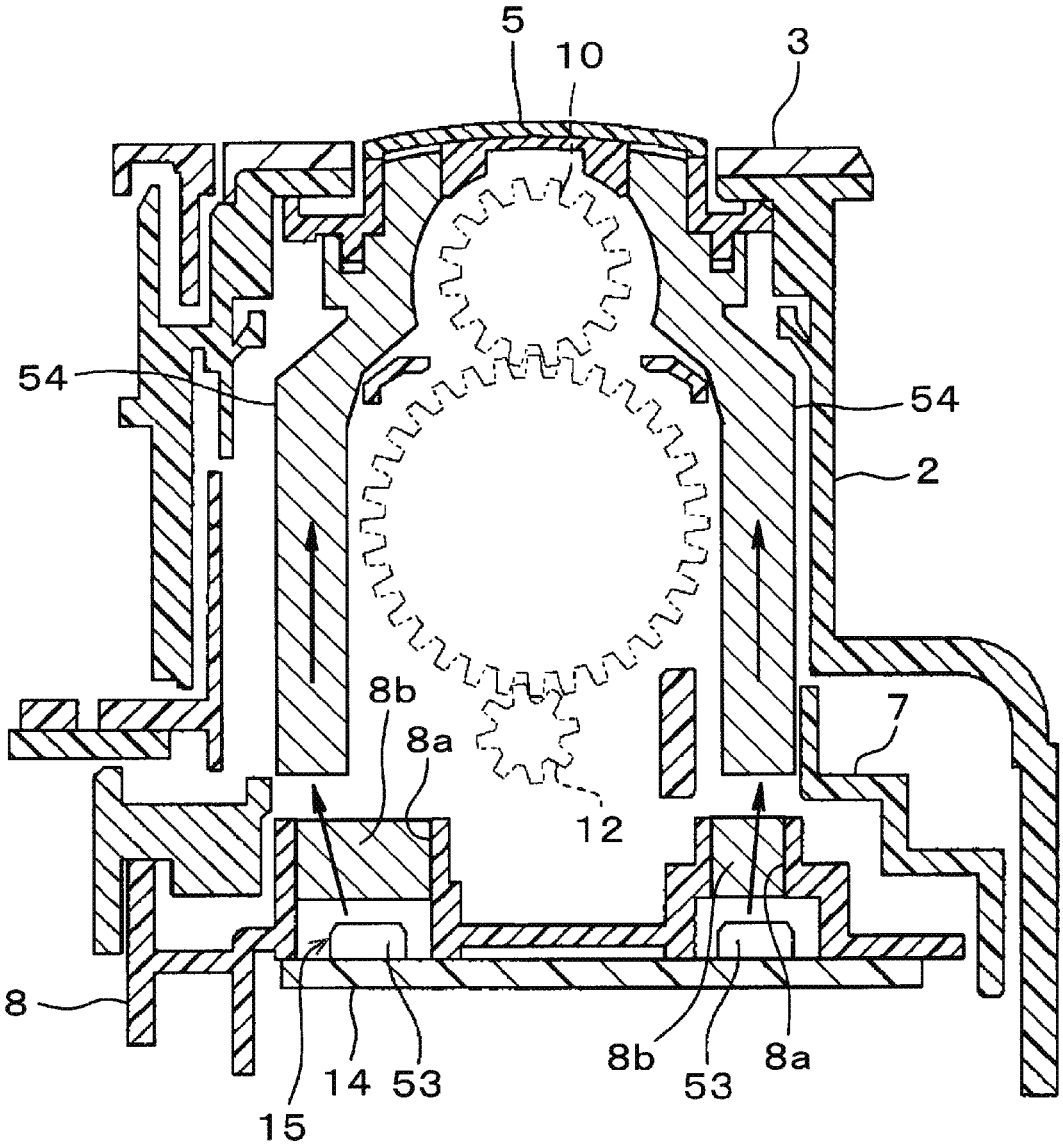
FIG. 3 is a cross-sectional view taken along line III-Ill in FIG. 1.

As shown in FIGS. 2 and 3, the casing 2 is a member shaped in a box form and receives various constituent members of the operation device 1. A first holder 7, a second holder 8, the scroll wheel 4, a rotational direction indicator 5, an indicator 9, a first gear 10, a second gear 11, a third gear 12, a shaft 13, a circuit board 14, an illuminator 15 and a rotation sensing mechanism 16 are received in the inside of the casing 2.

The operation surface 3 of the casing 2 is a surface of the casing 2, which faces an operator (hereinafter referred to as an occupant) side, and the operation surface 3 forms an air conditioning operation panel. The operation surface 3 is basically coated with, for example, a light-shielding paint and serves as a light-shielding portion. However, a region of the operation surface 3, which corresponds to the indicator 9, is formed as a portion, at which the light-shielding coating is not applied, and this portion serves as a light-transmitting portion. An opening 17 of the casing 2 is a hole for projecting a portion of the scroll wheel 4 to the occupant side and exposing the rotational direction indicator 5 to the occupant side.

The first holder 7 includes support walls 21, 22, a locking wall 23 and a support portion 24. Wall surfaces of the support walls 21, 22 extend in a direction that is perpendicular to the operation surface 3. The support walls 21, 22 are wall portions that rotatably supports a shaft 25 of the second gear 11 and the shaft 13 of the third gear 12. The locking wall 23 is a wall portion that is placed adjacent to the support wall 21 and has a locking hole 23*a*, through which locking claws 26 of the shaft 25 are inserted. The support portion 24 is a member for securely supporting the indicator 9 at a location that is on one side of the scroll wheel 4 in the axial direction of the scroll wheel 4 and is on a back side of the operation surface 3.

At the inside of the casing 2, the scroll wheel 4 is rotatably supported in a direction that is along the operation surface 3. The scroll wheel 4 serves as an input switch device for setting the temperature of the conditioning air in response to a rotational operation of the scroll wheel 4 by the occupant. For example, when an operation point of the scroll wheel 4 is rotated toward the upper side in FIG. 1, the temperature of the conditioning air is set to be increased. In contrast, when the operation point of the scroll wheel 4 is rotated toward the lower side in FIG. 1, the temperature of the conditioning air is set to be decreased. The scroll wheel 4 includes a main body 31, a rotatable shaft 32, a stationary shaft 33, a click pin 34 and a spring 35.

The main body 31 is a portion that is rotated by the occupant and is shaped in a ring form. The main body 31 is formed as an assembly of a plurality of members, which include a first wheel 36, a second wheel 37 and a third wheel 38.

The first wheel 36 is a member in a ring form and forms one axial side of the main body 31, which is located on the rotatable shaft 32 side in the axial direction. The first wheel 36 is located on the rotatable shaft 32 side of a tubular portion 39 made of resin, and the first wheel 36 is formed integrally with the tubular portion 39 in one piece. That is, the first wheel 36 and the tubular portion 39 are formed as a one-piece molded component made of the resin. A predetermined number of locking claws 41 is arranged one after another in a circumferential direction at an axial intermediate location of an outer peripheral surface of the tubular portion 39, and the predetermined number of locking claws 41 is respectively engaged with a predetermined number of locking holes 40 of the third wheel 38 describe later. A coating having a predetermined color is applied to a surface of the first wheel 36. The coating may be a glossy coating or a matte coating.

Figure 9:
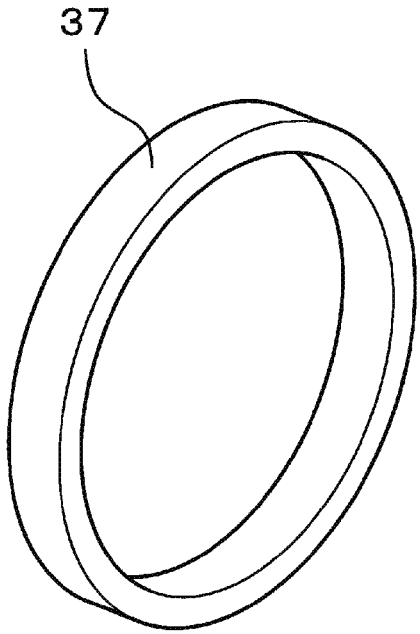
FIG. 9 is a perspective view of the second wheel.

As shown in FIG. 9, the second wheel 37 is a member (i.e., a ring member), which is in a ring form and forms an axial intermediate region of the main body 31. The second wheel 37 is formed by a light transmissive member, such as a transparent member, a translucent member or a light diffusing member, which is configured to transmit the light therethrough. In the case of the present embodiment, the second wheel 37 is made of, for example, acrylic resin or PC (polycarbonate) resin. A plurality of coating films and a metallic vapor deposition film are formed at surfaces of the second wheel 37, i.e., an inner peripheral surface, an outer peripheral surface and end surfaces of the second wheel 37. Detailed configurations of the coating films and the vapor deposition film of the second wheel 37 will be described later.

The third wheel 38 is a member shaped in a ring form and forms another axial side of the main body 31, which is located on the stationary shaft 33 side in the axial direction. A coating having a predetermined color is applied to a surface of the third wheel 38. The coating may be a glossy coating or a matte coating. The second wheel 37 side of the third wheel 38 is hollow, and an inner periphery of the ring of the third wheel 38 is formed by a tubular portion 42, which is shaped in a tubular form. The predetermined number of locking holes 40, to which the locking claws 41 are respectively engaged, is arranged one after another in the circumferential direction at the first wheel 36 side of the tubular portion 42.

The first to third wheels 36-38 and the stationary shaft 33 are assembled together as follows. Specifically, the stationary shaft 33, to which the click pin 34 is assembled, is inserted into the first wheel 36.

Furthermore, the second wheel 37 is inserted from the stationary shaft 33 side along the radially outer side of the tubular portion 39 such that the second wheel 37 contacts the first wheel 36. Then, the third wheel 38 is assembled to the tubular portion 39 from the stationary shaft 33 side. The second wheel 37 is securely clamped between the first wheel 36 and the third wheel 38. Furthermore, an inner peripheral surface of the tubular portion 42 of the third wheel 38 is inserted over the outer peripheral surface of the tubular portion 39 such that the inner peripheral surface of the tubular portion 42 contacts the outer peripheral surface of the tubular portion 39, and the locking claws 41 are respectively engaged with the locking holes 40. Thereby, the third wheel 38 is fixed to the tubular portion 39 of the first wheel 36.

The rotatable shaft 32 is a shat that supports the main body 31 along a direction, which extends along the operation surface 3, at the inside of the casing 2. The rotatable shaft 32 is configured to rotate integrally with the main body 31. A flange 43, which is in a circular plate form, is formed at an axial intermediate location of the rotatable shaft 32. The flange 43 is configured to limit movement of a foreign object, which intrudes through a gap around the main body 31, toward the first gear 10.

A portion of the first wheel 36, which is located on the rotatable shaft 32 side, forms an axial end surface of the scroll wheel 4. This axial end surface forms a slide surface 44. Furthermore, a surface of the flange 43, which is opposed to the slide surface 44, forms a slide surface 45. A size of a gap between the slide surface 44 and the slide surface 45 is set to be slightly larger than a plate thickness of the support wall 22. The support wall 22 is held between the slide surface 44 and the slide surface 45. Therefore, an axial position of the rotatable shaft 32, i.e., the scroll wheel 4 relative to the support wall 22 is limited by the slide surface 44 and the slide surface 45.

A corrugated portion 46, which forms a click mechanism, is formed at an inner peripheral surface of the tubular portion 39 of the rotatable shaft 32. The corrugated portion 46 forms a series of projections and recesses, which are arranged one after another in the circumferential direction of the tubular portion 39 like internal teeth of an internal gear.

The stationary shaft 33 is a shaft that rotatably supports the main body 31 and the rotatable shaft 32. One side of the stationary shaft 33 is fixed to a support wall 47 of the first holder 7, and the other side of the stationary shaft 33 is inserted into an inside of the tubular portion 39 of the rotatable shaft 32. A portion of the stationary shaft 33, which is inserted into the inside of the tubular portion 39, has a hole 48 that is inwardly recessed in a direction, which crosses the axial direction, at a predetermined circumferential region of an outer peripheral surface of the portion of the stationary shaft 33 to correspond with the corrugated portion 46.

The click pin 34 is a member that forms the click mechanism in corporation with the corrugated portion 46. A distal end part of the click pin 34 is shaped in, for example, a spherical surface form, and the other end part side of the click pin 34 is shaped in a tubular form. The click pin 34 is inserted into the hole 48 such that the distal end part of the click pin 34 contacts the corrugated portion 46. The spring 35 is a resilient member that forms the click mechanism in cooperation with the corrugated portion 46 and the click pin 34. The spring 35 is interposed between the click pin 34 and a bottom of the hole 48 and is configured to apply an urging force against the click pin 34 toward the corrugated portion 46.

The indicator 9 indicates an input state, which corresponds to the rotational operation of the scroll wheel 4. The indicator 9 is located on the one axial side of the scroll wheel 4 and is placed on the back side of the operation surface 3 at a location that is adjacent to the operation surface 3. The indicator 9 is configured to indicate, for example, the temperature of the conditioning air, the setting of which is changed. In the case of the present embodiment, the indicator 9 is a planar light-emitting display, such as an organic EL display. A display content, which is indicated at the indicator 9, i.e., a display image is visible to the occupant through the light-transmitting portion of the operation surface 3.

The first gear 10 is a spur gear that is fixed to the side of the rotatable shaft 32 of the scroll wheel 4, which is opposite to the indicator 9. The first gear 10 is configured to rotate integrally with the rotatable shaft 32. The first gear 10 serves as a reference gear for the second gear 11 and the third gear 12. The number of teeth of the first gear 10 is set to be, for example, twenty four.

The second gear 11 is placed on a side of the first gear 10, which is away from the operation surface 3. The second gear 11 is a spur gear that is meshed with the first gear 10 and is configured to be rotated at a reduced rotational speed that is reduced relative to a rotational speed of the first gear 10. The number of teeth of the second gear 11 is set to be, for example, forty eight while a diameter of the second gear 11 is twice as large as a diameter of the first gear 10.

The shaft 25, which is rotated integrally with the second gear 11, is fixed to the second gear 11. The shaft 25 extends from the second gear 11 toward the indicator 9 side. Two resilient portions 27, each of which has a thin wall and is resiliently deformable in the radial direction, is formed at the distal end side of the shaft 25. A locking claw 26, which radially outwardly projects, is formed at a foremost part of each of the resilient portions 27.

The resilient portions 27 and the locking claws 26 are inserted into the locking hole **23*a* of the locking wall 23 such that the locking claws 26 are engaged to a periphery of the locking hole 23*a*, and thereby axial removal of the shaft 25 is limited. Furthermore, the shaft 25 is rotatably supported by the support walls 21, 22 at two axial locations of the shaft 25, which are other than the resilient portions 27 and the locking claws 26**.

The third gear 12 is placed on a side of the second gear 11, which is away from the operation surface 3. The third gear 12 is a spur gear that is meshed with the second gear 11 and is configured to be rotated at an increased rotational speed that is increased relative to the rotational speed of the first gear 10. The number of teeth of the third gear 12 is set to be, for example, twelve while a diameter of the third gear 12 is one half of the diameter of the first gear 10. The shaft 13 is fixed to the third gear 12 and is configured to be rotated integrally with the third gear 12. The shaft 13 extends from the third gear 12 toward the indicator 9 side. The shaft 13 is rotatably supported by the support walls 21, 22 at two axial locations of the shaft 13.

The rotation sensing mechanism 16 is a mechanism that senses a rotational state of the scroll wheel 4 when the scroll wheel 4 is rotated. The rotation sensing mechanism 16 includes a rotary plate 51, which is fixed to an end part of the shaft 13 located on the indicator 9 side, and a photointerrupter 52, which is installed to the circuit board 14 shown in FIG. 6. The rotary plate 51 is configured to be rotated through the first to third gears 10-12 and the shaft 13 in response to the rotation of the scroll wheel 4.

A plurality of light shielding teeth is arranged one after another at predetermined intervals in the circumferential direction along an outer peripheral portion of the rotary plate 51, and thereby the rotary plate 51 is formed like a spur gear. Each of the light shielding teeth of the rotary plate 51 is shaped in a rectangular form and serves as a light-shielding portion that blocks the light in the axial direction of the rotary plate 51. The photointerrupter 52 is a sensor device that senses a rotational state of the rotary plate 51 and thereby senses a rotational state (a rotational direction, the amount of rotation) of the scroll wheel 4. In the case of the above structure, when a circumferential size of the respective light-shielding portions of the rotary plate 51 and a circumferential size of the respective slits of the rotary plate 51 are appropriately set relative to the light emitter and the light receiver of the photointerrupter 52, the rotational direction and the amount of rotation can be accurately obtained with the photointerrupter 52.

The circuit board 14 is a plate member, at which a control circuit is formed. The circuit board 14 is installed to the second holder 8 such that the circuit board 14 is parallel with the operation surface 3. A received light signal is outputted from the photointerrupter 52 to the circuit board 14, and the circuit board 14 senses the rotational direction and the amount of rotation of the rotary plate 51, i.e., the scroll wheel 4 based on a generated pattern of the received light signal. The circuit board 14 controls a change operation of the display content, i.e., a temperature display of the conditioning air at the indicator 9 according to the sensed rotational direction and the amount of rotation.

Furthermore, as shown in FIG. 1, two indication marks 5*a*, 5*b*, which are in a triangular form and indicate the rotational direction of the scroll wheel 4, i.e., the upper side and the lower side in FIG. 1, are formed at the rotational direction indicator 5. In the rotational direction indicator 5, the indication marks 5*a*, 5*b* are light-transmitting portions, to which the light-shielding coating is not applied. For example, when a nighttime illumination switch is turned on, the indication marks 5*a*, 5*b* are illuminated by light sources 53, 53 and rotational direction illumination light guide members 54, 54, which are shown in FIG. 3 and will be described later.

Figure 7:
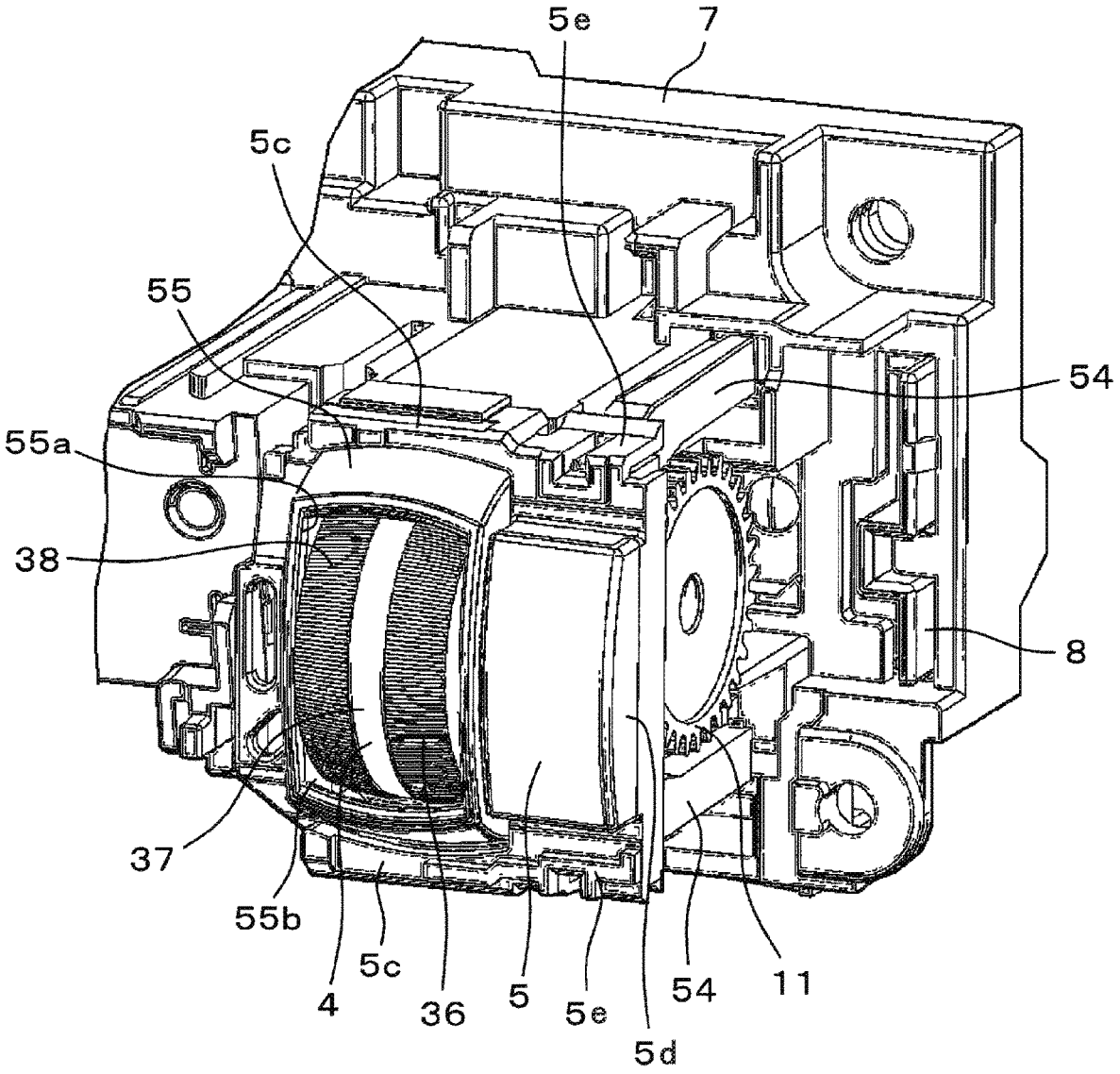
FIG. 7 is a perspective view of the operation device in a state where a casing is removed.
Figure 12:
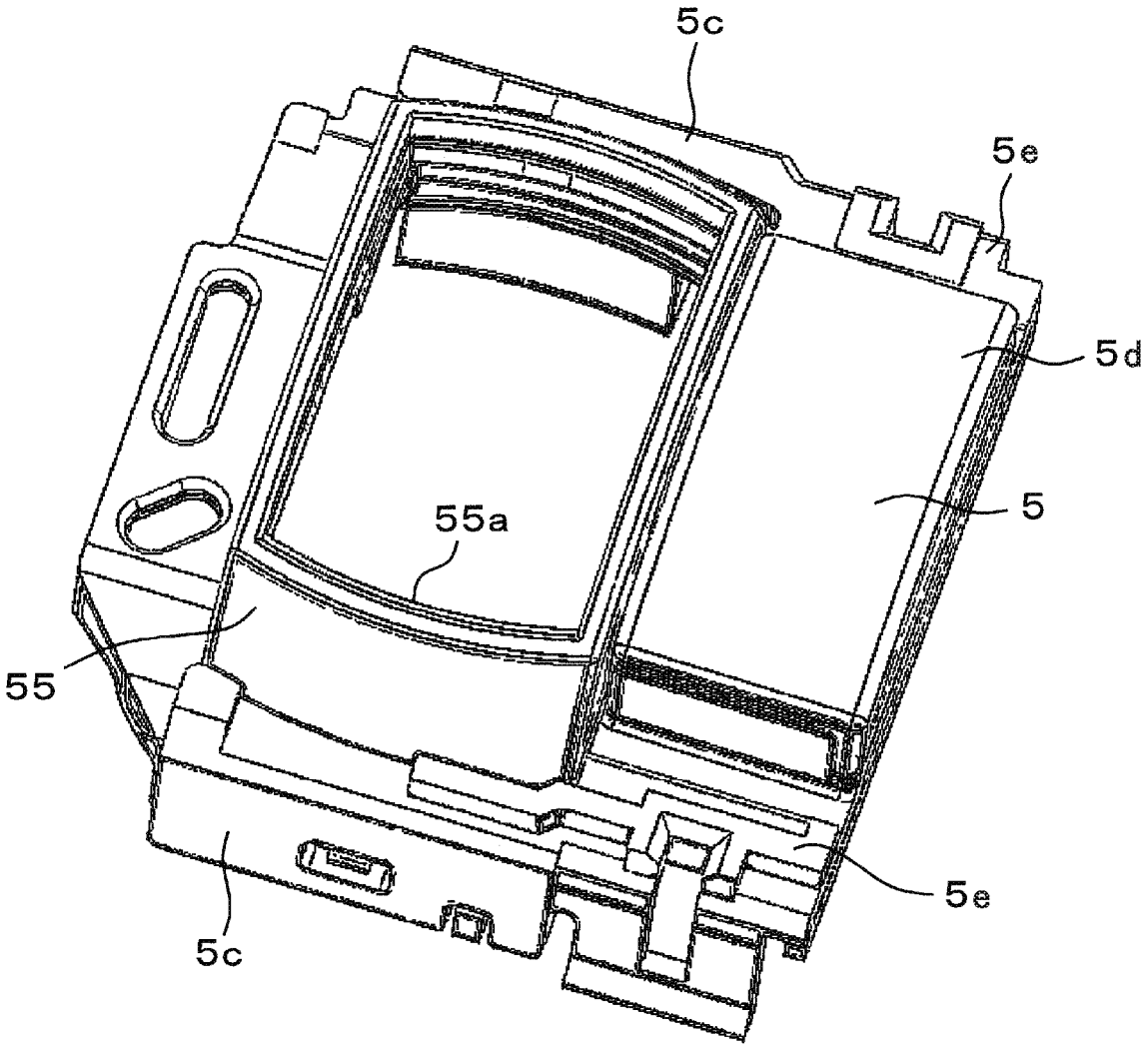
FIG. 12 is a perspective view showing a bezel and a rotational direction indicator.
Figure 17:
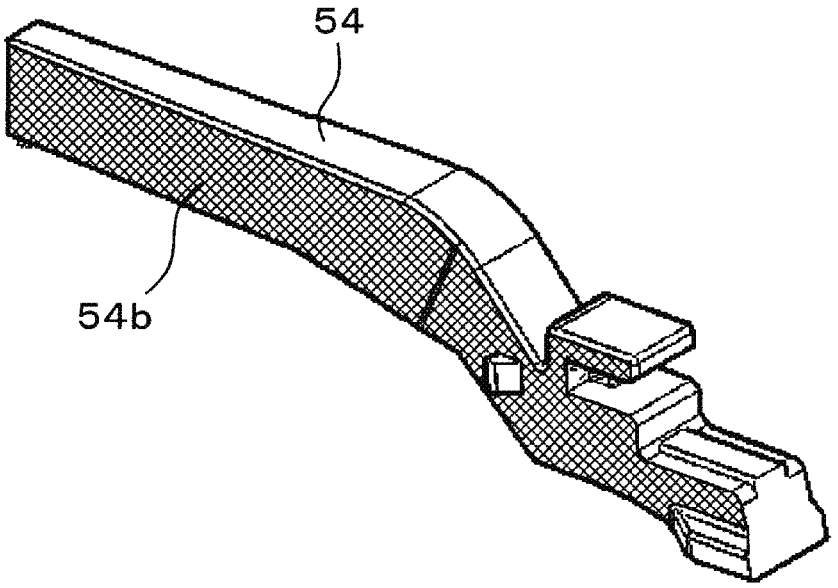
FIG. 17 is a perspective view of the rotational direction illumination light guide member.

As shown in FIGS. 7 and 12, the rotational direction indicator 5 includes: an indicator main body 5*d*; attachment portions 5*e*, 5*e*, which are respectively provided at the upper side and the lower side of the indicator main body 5*d*; and coupling portions 5*c*, 5*c*, which respectively project from the attachment portions 5*e*, 5*e* toward the left side in FIG. 12. Upper end parts of the light guide members 54, 54 shown in FIG. 3 are installed by, for example, engagement to a lower surface of the indicator main body 5*d* and the attachment portions 5*e*, 5*e*. As shown in FIG. 17, each of the light guide members 54 is shaped in an elongated rod form as a whole, and the end part of the light guide member 54, which is adjacent to the operation surface 3, is bent along the outer periphery of the first gear 10, as shown in FIG. 3. Each of the light guide members 54 is made of, for example, a transparent resin.

A bezel 55, from which a portion of the scroll wheel 4 projects forward, is clamped through, for example, engagement of the bezel 55 between the coupling portions 5*c*, 5*c* of the rotational direction indicator 5, so that the rotational direction indicator 5 and the bezel 55 are integrated together. The integrated structure of the bezel 55 and the rotational direction indicator 5 is securely fitted to the opening 17 of the casing 2 from the inside of the casing 2.

Figure 4:
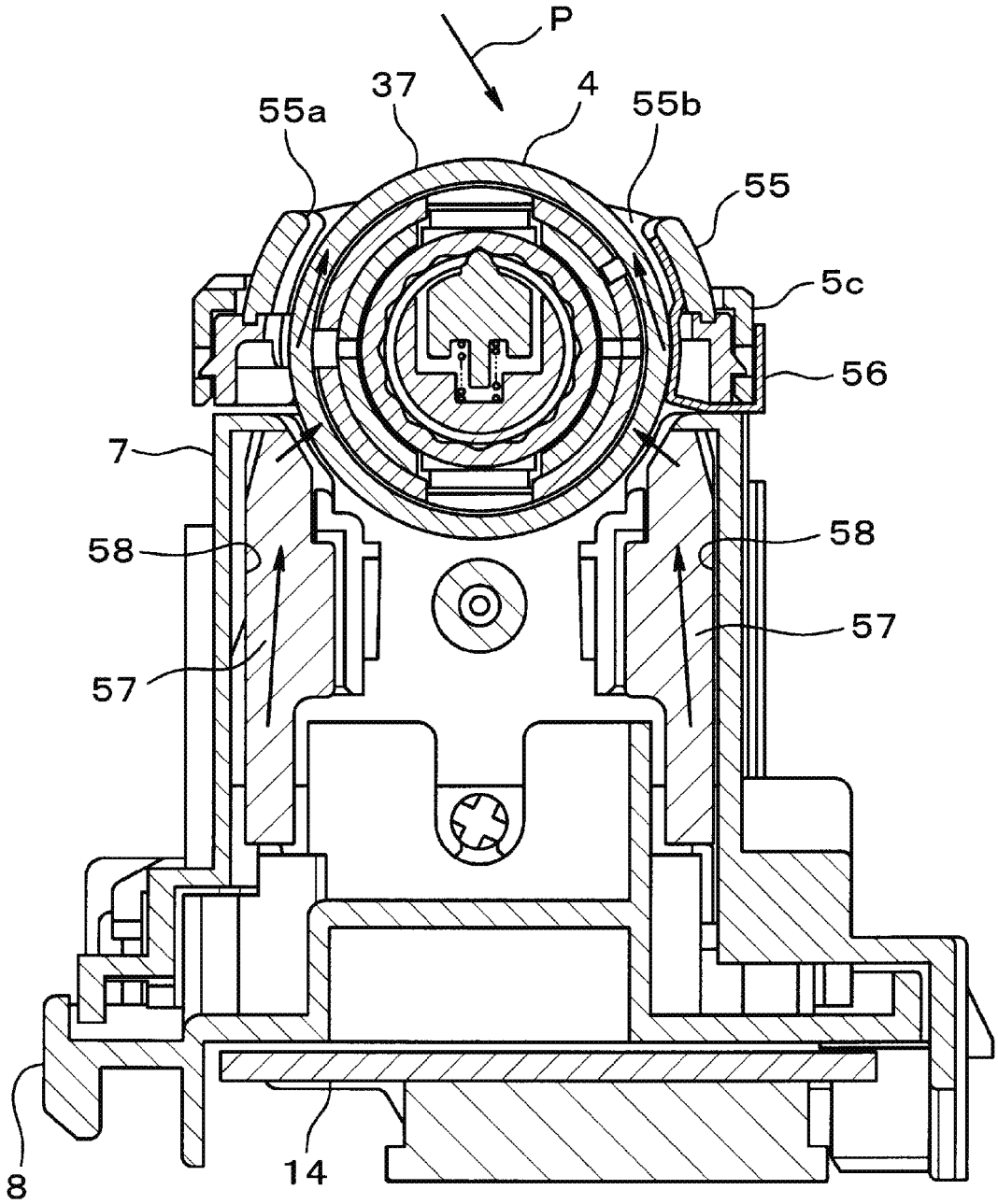
FIG. 4 is a cross-sectional view taken along line IV-IV in FIG. 1.
Figure 13:
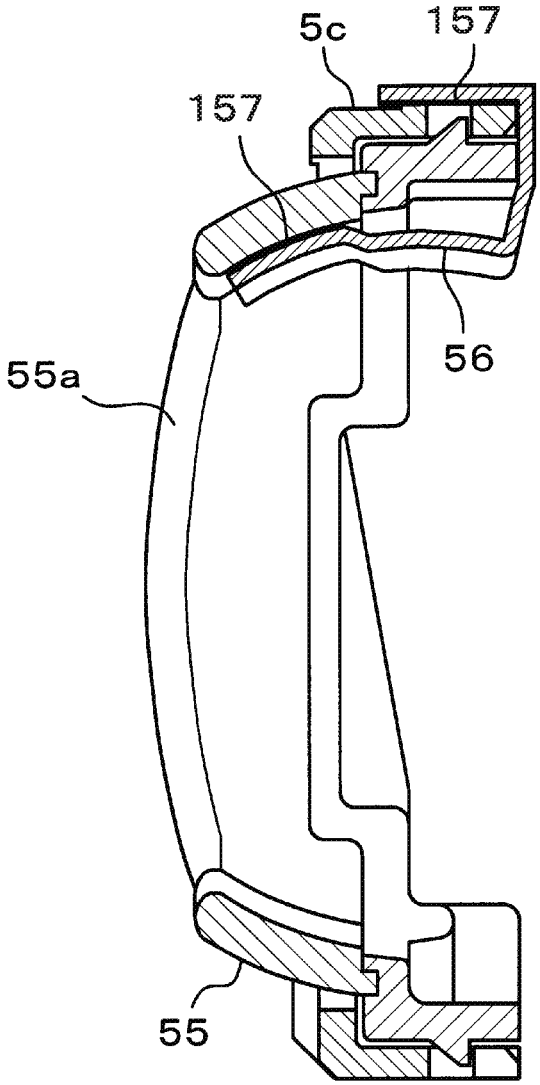
FIG. 13 is a cross-sectional view showing the bezel and the rotational direction indicator.

The bezel 55 is coated with, for example, a light-shielding paint and is thereby formed as a light-shielding portion. The bezel 55 has an opening 55*a*, which is shaped in a rectangular form, and the opening 55*a* is a hole, through which the portion of the scroll wheel 4 is projected toward the occupant. As shown in FIGS. 4 and 7, a gap 55*b* is formed between the opening 55*a* and the scroll wheel 4 such that the gap 55*b* extends all around a periphery of the opening 55*a*. As shown in FIGS. 4 and 13, a nonwoven fabric 56 is attached to the inner side of the bezel 55 and the outer side of the bezel 55, i.e., the outer side of the coupling portion 5*c* with double-sided tapes 157, 157 to limit leakage of the illumination light described later through the upper side gap 55*b*. Details of the nonwoven fabric 56 will be described later. FIG. 4 is a cross-sectional view taken along line IV-IV in FIG. 1.

Figure 5:
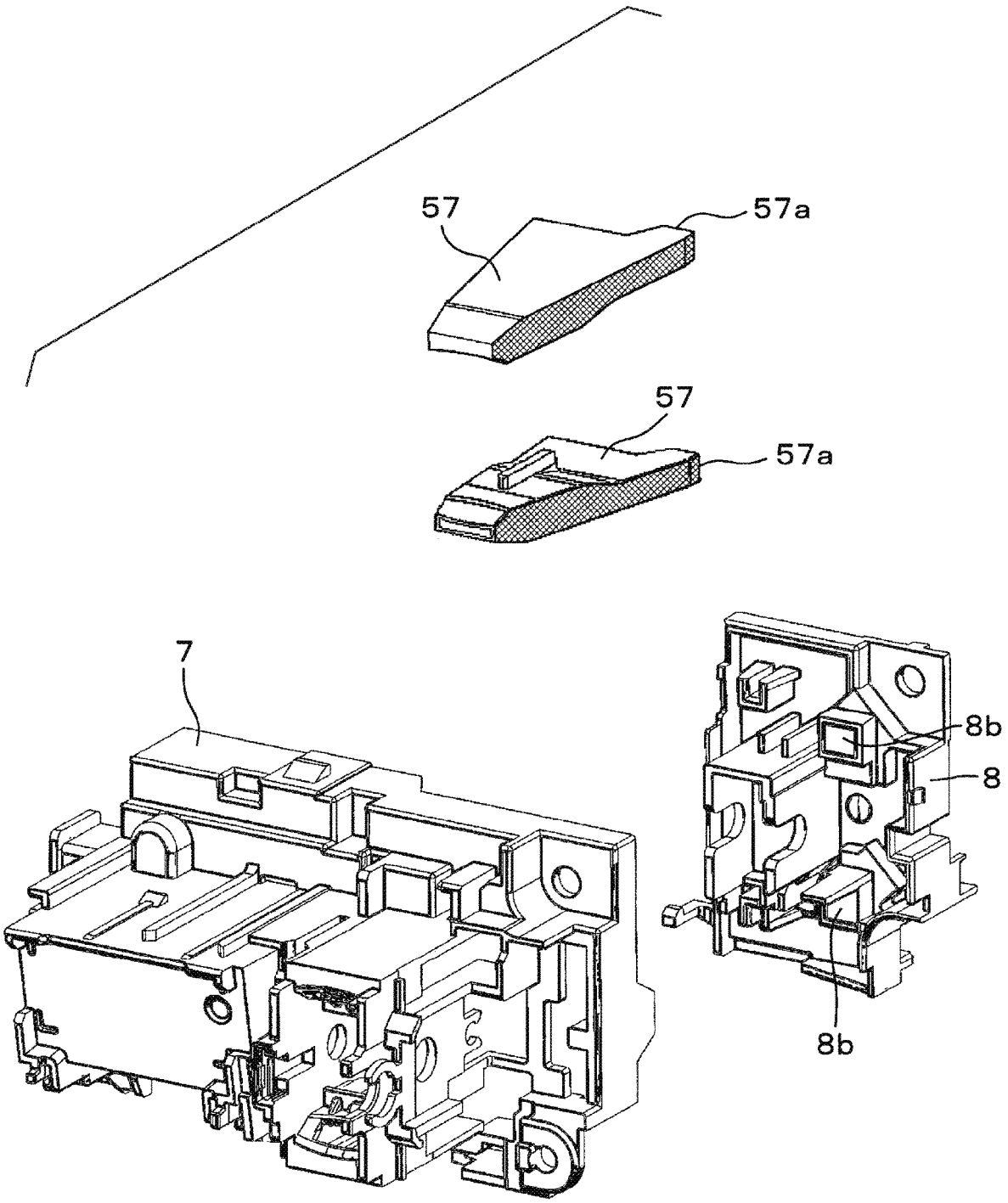
FIG. 5 is an exploded perspective view of a first holder, a second holder, and wheel illumination light guide members.

Furthermore, as shown in FIG. 3, the light sources 53, 53 of the illuminator 15 are installed to the circuit board 14. Each of the light sources 53, 53 is formed by a light emitting element, such as an LED. The light sources 53, 53 are placed to correspond to the light guide members 54, 54 that respectively illuminate the indication marks 5*a*, 5*b* of the rotational direction indicator 5. The circuit board 14 is installed to a lower surface of the second holder 8, which is also shown in FIG. 5. The second holder 8 has openings 8*a*, 8*a* at locations that respectively correspond to the light sources 53, 53, and transparent lenses 8*b*, 8*b*, which transmit the light, are respectively installed at the openings 8*a*, 8*a*. The second holder 8 is made of, for example, black color resin, and the lenses 8*b*, 8*b* are made of, for example, transparent resin. Furthermore, the second holder 8 and the lenses 8*b*, 8*b* are formed by, for example, a two-color molding technique.

Figure 6:
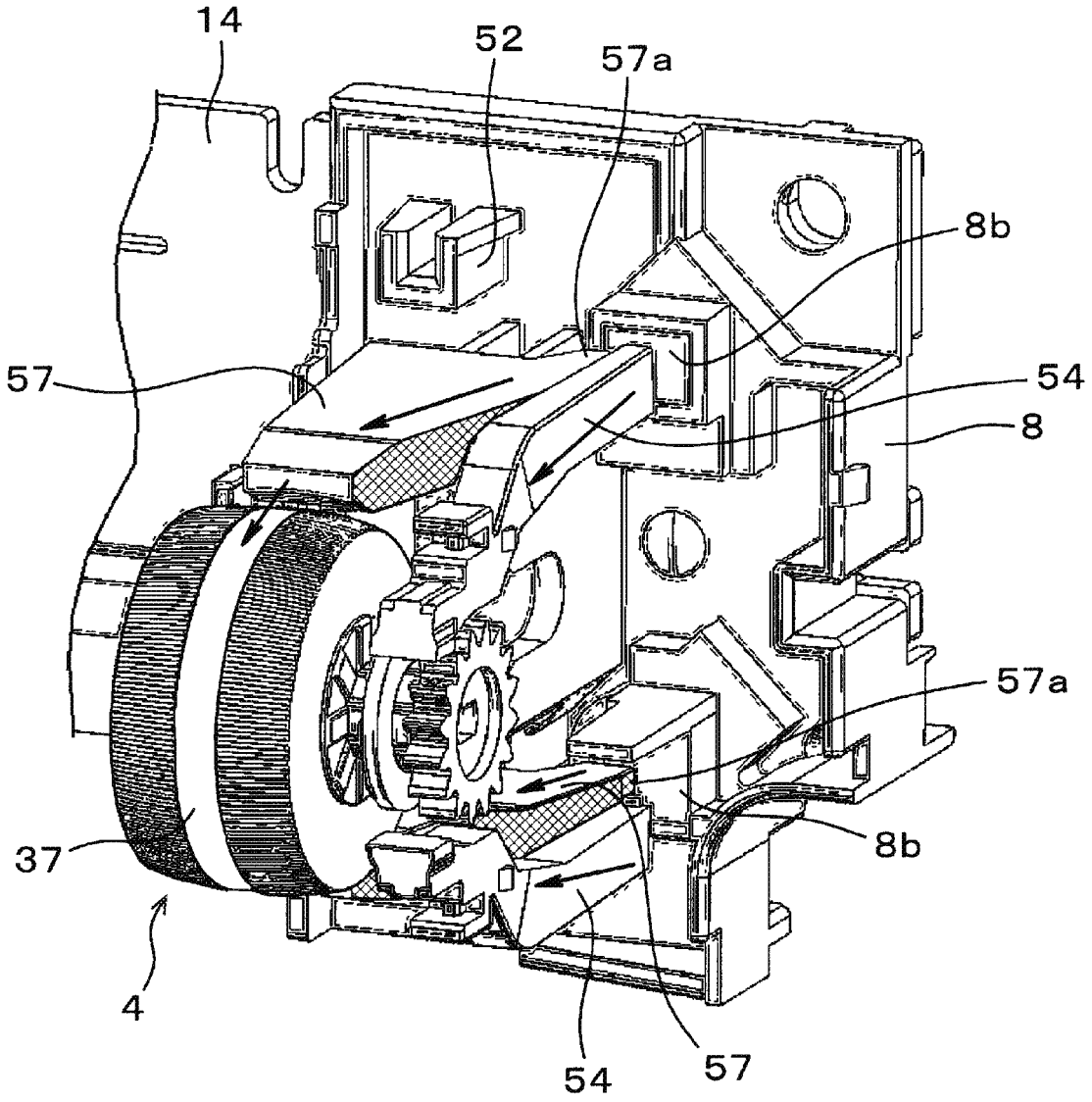
FIG. 6 is a perspective view showing a scroll wheel, rotational direction illumination light guide members, the wheel illumination light guide members, the second holder and a circuit board.

In the above structure, as indicated by arrows in FIGS. 3 and 6, the light, which is outputted from each of the light sources 53, 53, is outputted from a distal end surface of the corresponding one of the light guide members 54, 54 to the corresponding one of the indication marks 5*a*, 5*b* of the rotational direction indicator 5 after passing through the corresponding one of the lenses 8*b*, 8*b* and the corresponding one of the light guide members 54, 54. FIG. 6 is a perspective view indicating the scroll wheel 4, the light guide members 54, 54, the second holder 8 and the circuit board 14 in a state where the casing 2, the bezel 55, the rotational direction indicator 5 and the first holder 7 are removed.

Figure 16:
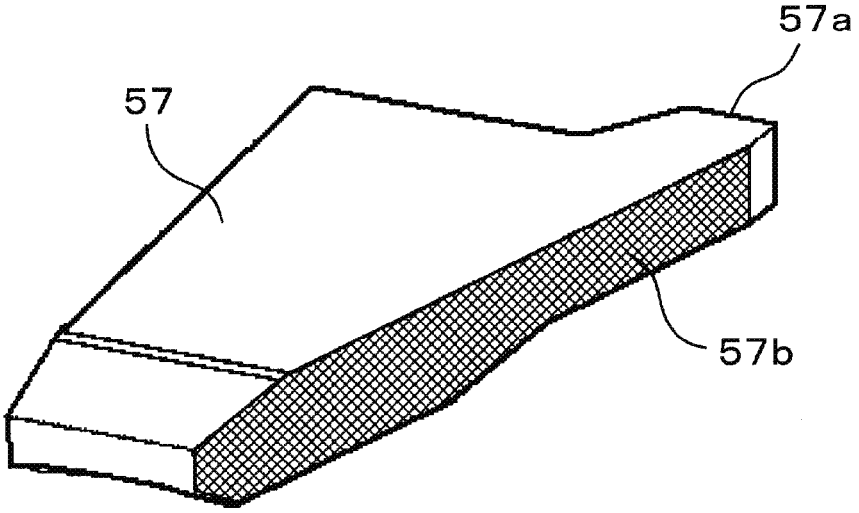
FIG. 16 is a perspective view of the wheel illumination light guide member.

As shown in FIG. 6, light guide members 57, 57 are placed on the left side of the rotational direction illumination light guide members 54, 54. As shown in FIGS. 5 and 16, each of the light guide members 57, 57 is shaped in a plate form as a whole and is made of, for example, transparent resin. As shown in FIGS. 4 and 5, the light guide members 57, 57 are respectively received in receiving portions 58, 58 of the first holder 7, and the second holder 8, at which the circuit board 14 is installed, is received in and is fixed to the first holder 7 that receives the light guide members 57, 57.

A projection 57*a* projects from an end part of each light guide member 57, which is far from the operation surface 3, and the projection 57*a* is placed adjacent to a corresponding one of the lenses 8*b*, 8*b* of the second holder 8, as shown in FIG. 6. In this way, as indicated by arrows in FIGS. 4 and 6, the light, which is outputted from each of the light sources 53, 53, is outputted from a distal end part of the corresponding one of the wheel illumination light guide members 57, 57 to the second wheel 37 of the scroll wheel 4 after passing through the corresponding one of the lenses 8*b*, 8*b* and the corresponding one of the wheel illumination light guide members 57, 57. Then, the light, which enters the second wheel 37, is transmitted in an inside of the second wheel 37 and is guided to the portion of the second wheel 37, which projects from the opening 55*a* of the bezel 55, to illuminate this portion of the second wheel 37.

Figure 10:
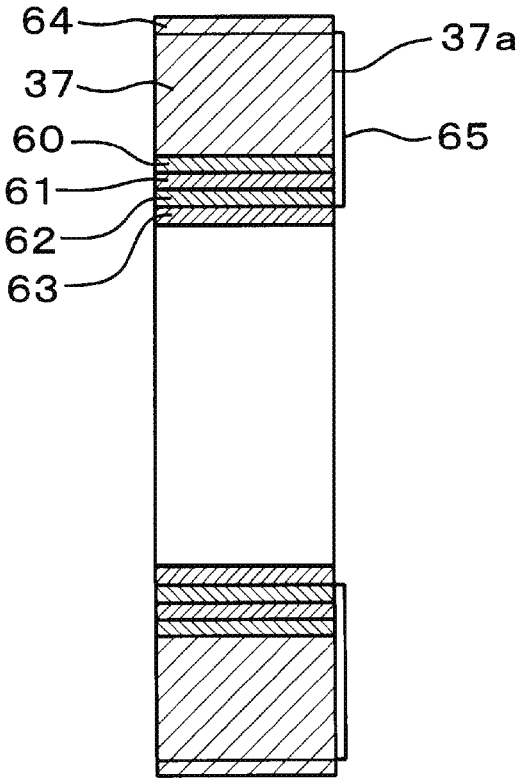
FIG. 10 is a diagram schematically showing a cross section of the second wheel.

Now, detailed structures of the coating films and the vapor deposition film of the second wheel 37 will be descried with reference to FIGS. 9 and 10. A ring main body of the second wheel 37 is made of, for example, transparent acrylic resin. An undercoat film 60, a middle coat film 61, a vapor deposition film 62 and a top coat film 63 are layered in this order from an inner peripheral surface side of the ring main body. A texture coating film 64 is formed at an outer peripheral surface of the second wheel 37. A printed film 65, which has a gray color, is formed at an end surface 37*a* of the second wheel 37 where a gate trace, which is a trace of a gate of a resin molding die used for molding the second wheel 37, is left.

The undercoat film 60 is a protective film and is formed by coating, for example, a transparent paint. A film thickness of the undercoat film 60 is set to be, for example, about 7 μm. The middle coat film 61 is a protective film and is formed by coating, for example, a transparent paint. A film thickness of the middle coat film 61 is set to be, for example, about 8 μm. Here, it should be noted only one of the undercoat film 60 and the middle coat film 61 may be formed depending on a need.

The vapor deposition film 62 is formed by vapor deposition of metal, such as In (indium). A film thickness of the vapor deposition film 62 is set to be, for example, about 200 Å. By forming the vapor deposition film 62, as indicated by an arrow in FIG. 11, the light, which enters the second wheel 37, is reflected by a surface of the vapor deposition film 62 located on the inner peripheral surface side of the vapor deposition film 62 and is repeatedly reflected in the inside of the second wheel 37. Furthermore, since the surface of the vapor deposition film 62 has a beautiful metallic luster, a high level of design of the second wheel 37 and thereby a high level of design of the scroll wheel 4 are achieved. Here, it should be noted that the vapor deposition film 62 may be formed by using Sn (tin) or Al (aluminum) in place of In (indium). Furthermore, it is desirable that a discontinuous vapor deposition film (a non-conductive vacuum metallization film) is formed as the vapor deposition film 62.

The top coat film 63 is a protective film and is formed by coating, for example, a transparent paint. A film thickness of the top coat film 63 is set to be, for example, about 12 μm. Here, it should be noted that the top coat film 63 may be formed by two layers of the protective film depending on a need.

The texture coating film 64 is a light diffusing and protective film and is formed by texture-coating of, for example, a transparent paint. A film thickness of the texture coating film 64 is set to be, for example, about 6 μm. Here, it should be noted that the texture coating film 64 may not be formed depending on a need. Furthermore, when the second wheel 37 is formed with the molding die, the outer peripheral surface of the second wheel 37 may be textured with the molding die instead of using the texture coating film 64.

The printed film 65 is a film for concealing the gate trace formed at the end surface 37*a* of the second wheel 37, and the printed film 65 is formed by printing the paint, such as the gray color paint, which diffuses the light. A thickness of the printed film 65 is set to, for example, about 8 μm. Here, it should be noted that the printed film 65 may not be formed depending on a need.

Figure 8:
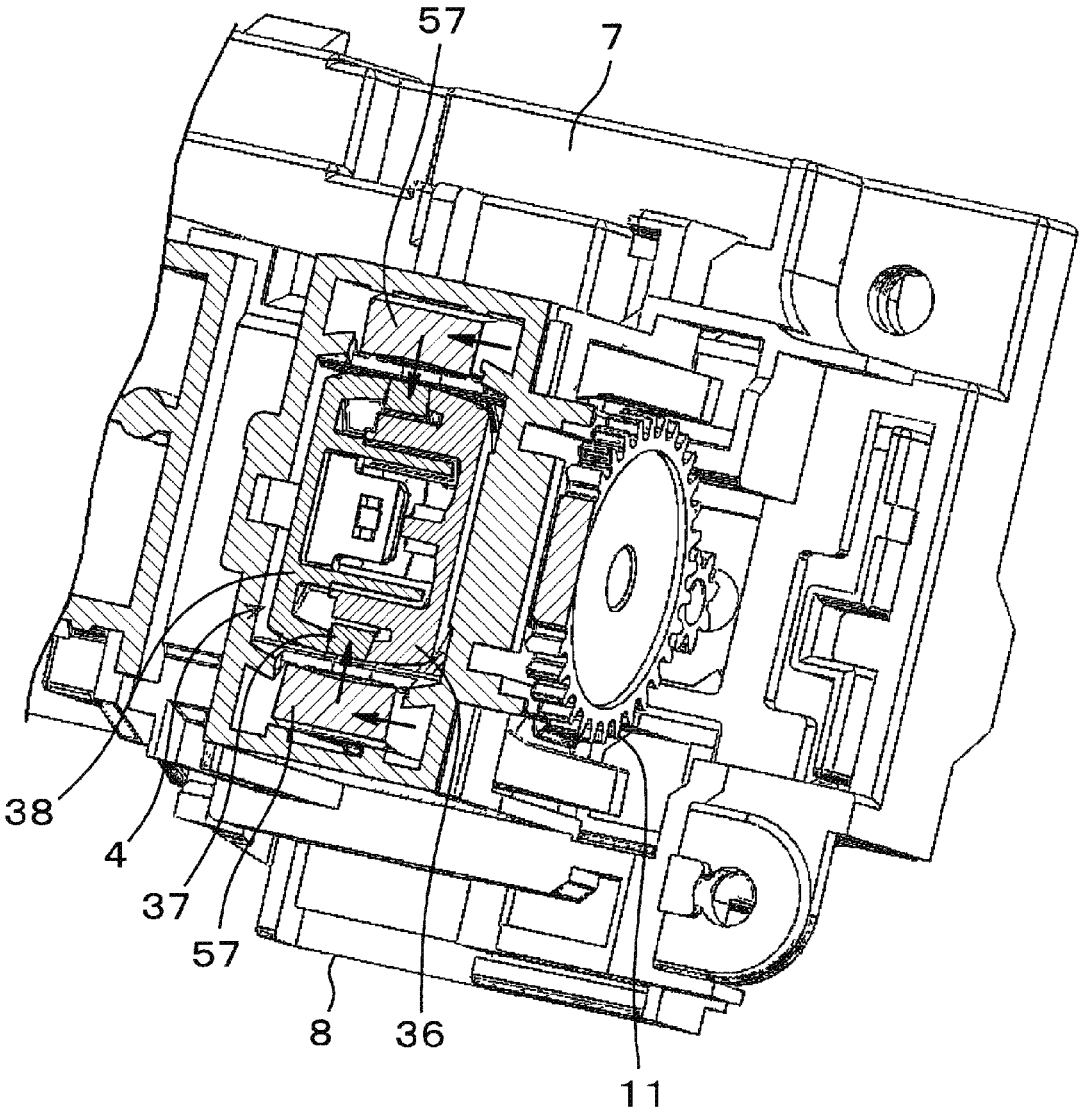
FIG. 8 is a perspective view showing a cross section of a structure taken along a plane parallel to an operation surface at a location near a top of a second gear.
Figure 11:
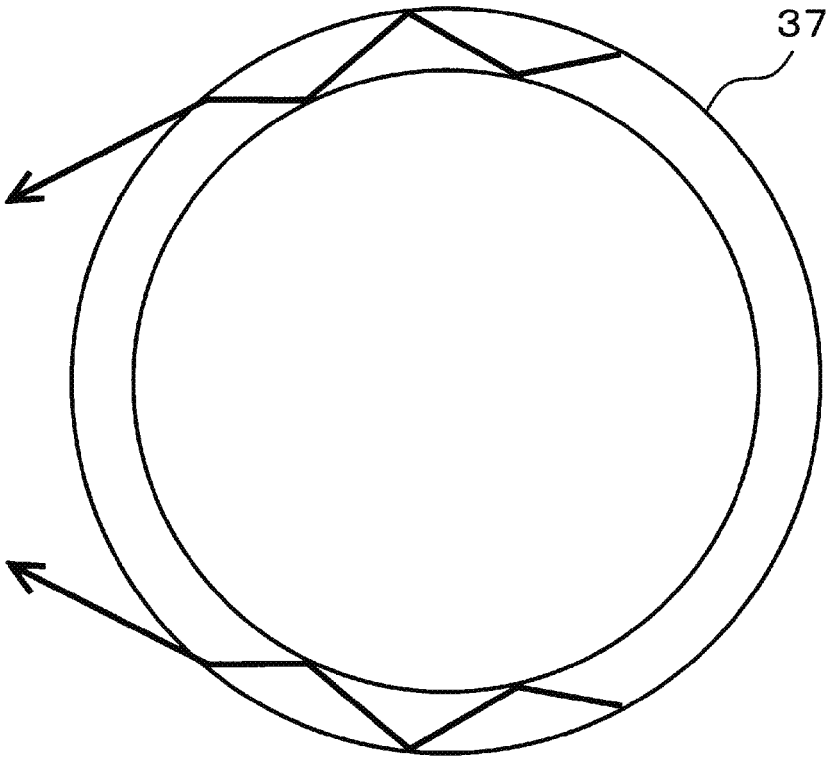
FIG. 11 is a diagram for explaining how light passes through an inside of the second wheel.

With respect to the second wheel 37 constructed in the above-described manner, when each of the light sources 53, 53 of the illuminator 15 outputs the light in response to the turning on of the nighttime illumination switch, the light outputted from each light source 53 passes through the corresponding lens 8*b* and the corresponding wheel illumination light guide member 57 and is outputted from the distal end part of the corresponding wheel illumination light guide member 57 to the second wheel 37 of the scroll wheel 4, as shown in FIGS. 4, 6 and 8. Then, the light, which enters the inside of the second wheel 37, is reflected by the vapor deposition film 62 and is repeatedly reflected at the inside of the second wheel 37, as shown in FIG. 11, and thereby the light is guided to the portion of the second wheel 37, which projects from the opening 55*a* of the bezel 55, to illuminate this portion of the second wheel 37. FIG. 8 is a perspective view showing a cross section of the structure taken along a plane parallel to the operation surface at a position near a top of the second gear 11 in FIG. 7 while the rotational direction illumination light guide members 54, 54 are removed.

Furthermore, in the present embodiment, since the surface of the vapor deposition film 62 of the second wheel 37 has the beautiful metallic luster, a high level of design of the second wheel 37 and thereby a high level of design of the entire scroll wheel 4 are achieved during the daytime, i.e., at the time when the light sources 53, 53 of the illuminator 15 are turned off.

Furthermore, as shown in FIG. 1, the gap 55*b* is formed between the opening 55*a* of the bezel 55 and the scroll wheel 4. In this structure, as shown in FIG. 4, the light, which is guided into the inside of the scroll wheel 4, may possibly leak from the upper side (the right side in FIG. 4) gap 55*b* and the lower side (the left side in FIG. 4) gap 55*b* at the bezel 55 at the time of providing the nighttime illumination. When such light leakage occurs, the upper side gap 55*b* and the lower side gap 55*b* of the bezel 55 look brighter than the second wheel 37 of the scroll wheel 4, so that it is difficult for the occupant to understand that the scroll wheel 4 is the operation subject. Among the light leakages from the upper side gap 55*b* and the lower side gap 55*b*, the light leakage from the lower side gap 55*b* does not enter the eyes of the occupant since a viewing angle from an eye point of the occupant is an angle of an arrow P in FIG. 4. However, the light leakage from the upper side gap 55*b* can be easily seen from the occupant and can enter the eyes of the occupant, and therefore countermeasures are necessary.

In the present embodiment, as shown in FIGS. 4 and 13, the nonwoven fabric 56 is bonded to the inner side and the outer side of the bezel 55 with double-sided tapes 157, 157. In this case, the nonwoven fabric 56 is bonded such that the nonwoven fabric 56 is sagging and always contacts the outer peripheral surface of the scroll wheel 4. Therefore, the leakage of the illumination light from the upper side gap 55*b* can be limited with the nonwoven fabric 56. Furthermore, in the case of the above structure, since there is room for the nonwoven fabric 56 to sag, the nonwoven fabric 56 does not hit the scroll wheel 4 strongly. Therefore, when the scroll wheel 4 is rotated, the scroll wheel 4 does not rub against the nonwoven fabric 56. As the nonwoven fabric 56, it is preferable to use a nonwoven fabric made of polyester, polyurethane or the like, such as Ecsaine (registered trademark) of Toray Industries, Inc.

Figure 14:
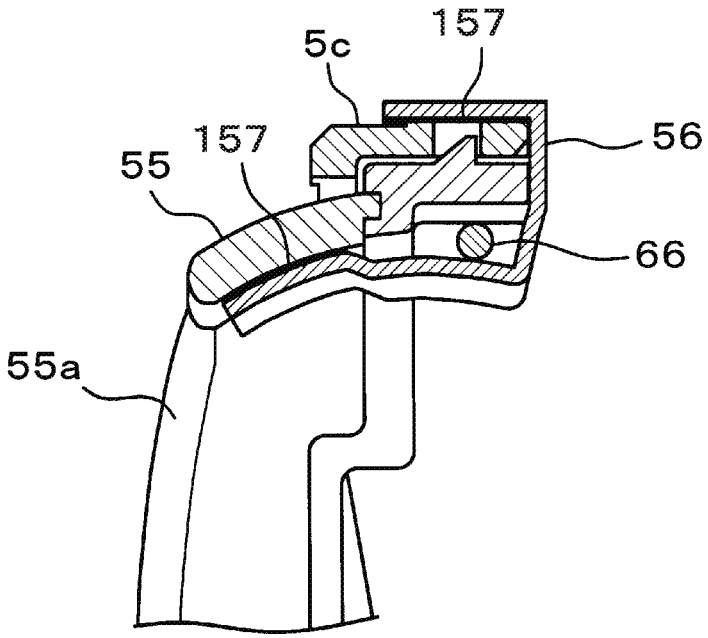
FIG. 14 is a partial cross-sectional view showing the bezel and the rotational direction indicator in the middle of a manufacturing process.

Here, at the time of boding the nonwoven fabric 56 in the state where the nonwoven fabric 56 is sagging, as shown in FIG. 14, a pin 66 is placed at the inside of the bezel 55, and the nonwoven fabric 56 is wound around the pin 66. The pin 66 is removed after the bonding of the nonwoven fabric 56. Thereby, the room for sagging the nonwoven fabric 56 can be reliably provided.

Figure 15:
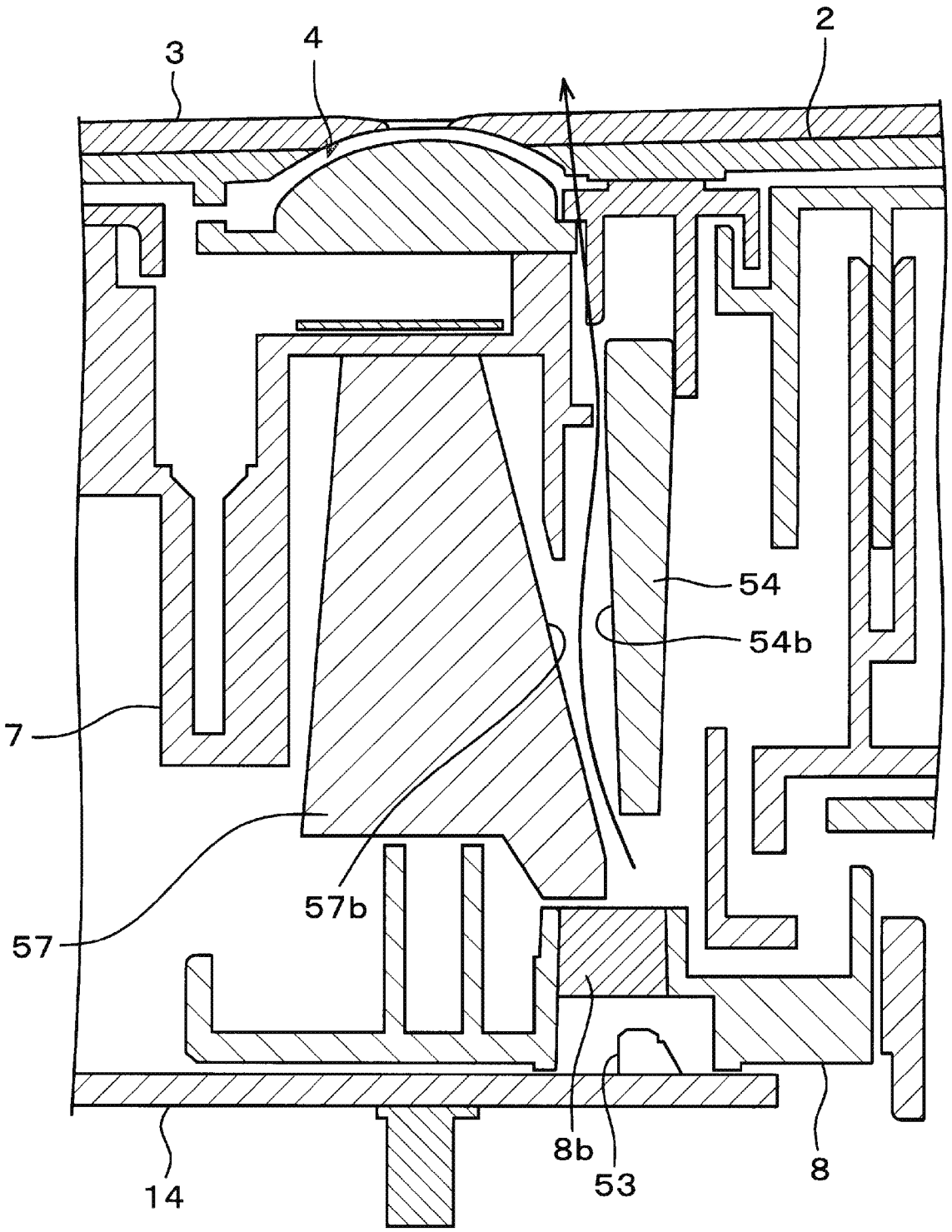
FIG. 15 is a cross-sectional view taken along line XV-XV in FIG. 1.

Furthermore, the nighttime illumination light may possibly leak from the left side gap 55*b* and the right side gap 55*b* of the bezel 55. Specifically, FIG. 15 is a cross-sectional view taken along line XV-XV in FIG. 1. As indicated in FIG. 15, the light, which is outputted from the light source 53, would be reflected by a side surface 54*b* of the rotational direction illumination light guide member 54 and the side surface 57*b* of the wheel illumination light guide member 57, which are opposed to each other. Thus, this reflected light would be transmitted along a path indicated by an arrow in FIG. 15, so that the reflected light would leak from the left side gap 55*b* and the right side gap 55*b* of the bezel 55.

In the present embodiment, in order to limit this light leakage, as shown in FIGS. 16 and 17, for example, a black color paint is printed to the side surface 54*b* of each rotational direction illumination light guide member 54 and the side surface 57*b* of the corresponding wheel illumination light guide member 57, which are opposed to each other. By the black color paint printed at the side surface 54*b* and the side surface 57*b*, the light, which is outputted from the light source 53, is not reflected by the side surfaces 54*b*, 57*b*, which are opposed to each other. Thus, it is possible to limit the leakage of the light through the left and right side gaps 55*b* of the bezel 55.

As shown in FIG. 1, the switch device 6, which is placed adjacent to the rotational direction indicator 5 at the operation surface 3, is a switch for changing a set value of another control parameter of the air conditioner, i.e., a set condition. The switch device 6 is formed as, for example, an automatic (AUTO) switch for setting an operational state of the air conditioner to an automatic control state. The switch device 6 is configured to output an input signal, which is generated at the time of input manipulation of the switch device 6 by the occupant, to the circuit board 14.

Furthermore, the circuit board 14 outputs a command to the air conditioner such that the control content, which is assigned to the switch device 6, is implemented by the air conditioner according to the input state of the switch device 6. Here, when the switch device 6 is depressed, the circuit board 14 outputs a command for executing the automatic control (e.g., AUTO control) to the air conditioner. When the switch device 6 is depressed once again, the circuit board 14 outputs a command for cancelling the automatic control to the air conditioner.

In the present embodiment constructed in the above-described manner, the scroll wheel 4 includes the second wheel 37, which is formed by the light transmissive member that is configured to transmit the light, and there are provided the wheel illumination light guide members 57, 57, each of which guides the light outputted from the corresponding one of the light sources 53, 53 for the nighttime illumination to the second wheel 37. Furthermore, the metal film 62 is formed at the inner peripheral surface of the second wheel 37. With the above-described configuration, during the time of providing the nighttime illumination, the light, which is outputted from each light source 53, passes through the corresponding lens 8*b* and the corresponding wheel illumination light guide member 57 and is outputted from the distal end part of the wheel illumination light guide member 57 to the second wheel 37 of the scroll wheel 4. Then, the light, which enters the inside of the second wheel 37, is reflected by the surface of the metal film 62 formed at the inner peripheral surface of the second wheel 37 and is repeatedly reflected at the inside of the second wheel 37, and thereby the light is guided to the portion of the second wheel 37, which projects from the opening 55*a* of the bezel 55, to illuminate this portion of the second wheel 37. Furthermore, since the surface of the vapor deposition film 62 of the second wheel 37 has the beautiful metallic luster, the high level of design of the second wheel 37 and thereby the high level of design of the entire scroll wheel 4 are achieved at the daytime, i.e., at the time when the light sources 53, 53 are turned off. Therefore, according to the present embodiment, although the scroll wheel 4 is illuminated at the nighttime, the high level of daytime design and the high level of nighttime design of the scroll wheel 4 can be achieved.

Furthermore, in the present embodiment, the nonwoven fabric 56 is attached to the adjacent portion, which is adjacent to the opening 55*a* of the bezel 55 at the inside of the operation surface 3, such that the nonwoven fabric 56 contacts the scroll wheel 4, and at this time, the nonwoven fabric 56 is attached in the state where the nonwoven fabric 56 is sagging. With this structure, the leakage of the illumination light from the upper side gap 55*b* of the bezel 55 can be limited with the nonwoven fabric 56. Furthermore, in the case of the above structure, since there is room for the nonwoven fabric 56 to sag, the nonwoven fabric 56 does not hit the scroll wheel 4 strongly. Therefore, when the scroll wheel 4 is rotated, the scroll wheel 4 does not rub against the nonwoven fabric 56.

Furthermore, in the above-described embodiment, the rotational direction indicator 5 is placed adjacent to the scroll wheel 4, and there are provided the rotational direction illumination light guide members 54, 54 that respectively guide the light, which is outputted from the corresponding one of the light sources 53, 53, to the rotational direction indicator 5. With this structure, the scroll wheel 4 and the rotational direction indicator 5 can be simultaneously illuminated with the common light sources 53, 53, so that the number of the light sources can be reduced.

Furthermore, in the above-described embodiment, the second wheel 37 is made of the resin, and the paint, which diffuses the light, is printed at the portion (i.e., the end surface 37*a*) of the second wheel 37, at which the gate trace of the gate of the resin molding die is left. Thereby, the appearance of the second wheel 37 can be improved.

Furthermore, in the above-described embodiment, the black color paint is printed at the side surface 57*b* of each wheel illumination light guide member 57 and the side surface 54*b* of the corresponding rotational direction illumination light guide member 54, which are opposed to each other. With this structure, the light, which is outputted from each light source 53, is not reflected by the side surface 57*b* of the corresponding wheel illumination light guide member 57 and the side surface 54*b* of the corresponding rotational direction illumination light guide member 54, which are opposed to each other. Thereby, it is possible to limit the leakage of the light from the left side gap 55*b* and the right side gap 55*b* of the bezel 55.

Furthermore, in the above-described embodiment, the main body 31 of the scroll wheel 4 is formed as the assembly of the plurality of members, i.e., the first to third wheels 36-38. With this structure, the color, the gloss, and the like can be set differently among the three wheels, and thereby the scroll wheel 4, which is rich in design, can be realized.

In the above-described embodiment, the scroll wheel 4 is formed as the assembly of the three wheels 36, 37, 38. However, the present disclosure should not be limited to this configuration. For instance, the scroll wheel 4 may be made of a single ring member, or two ring members or four or more ring members.

Furthermore, in the above-described embodiment, the metal vapor deposition film 62 is formed at the inner peripheral surface of the second wheel 37. Alternative to the metal vapor deposition film 62, a metal plating film may be formed at the inner peripheral surface of the second wheel 37. In the case of this construction, the remaining protective films, which are other than the film 62, may be respectively constructed in a manner that is similar to the one discussed above, or the number of layers of the protective films, the thickness of the respective protective films and/or the presence or absence of the respective protective films may be appropriately changed.

Furthermore, in the above-described embodiment, the scroll wheel 4 is used to change the preset temperature of the conditioning air at the air conditioner. However, the present disclosure should not be limited to this, and the scroll wheel 4 may be used for other applications or other devices. For example, the scroll wheel 4 may be used for changing a discharge flow rate of the conditioning air, or for changing a volume of sound of an audio device.

Although the present disclosure has been described with reference to the embodiment, it should be understood that the present disclosure is not limited to the embodiment and the structures described in the embodiment. The present disclosure covers various modifications and equivalents within the scope of the present disclosure. In addition, various combinations and forms, as well as other combinations and forms including only one element, more or less, are within the scope and spirit of the present disclosure.

What is claimed is:

1. An operation device comprising:

a scroll wheel that is rotatably supported at an inside of a casing while a portion of the scroll wheel projects outward from an opening formed at an operation surface of the casing, wherein:

the scroll wheel is configured to be rotated about a rotational axis by an operator who touches the scroll wheel;

another portion of the scroll wheel, which is diametrically opposed to the portion of the scroll wheel projecting outward from the opening about the rotational axis, is located at the inside of the casing; and the scroll wheel includes a ring member that is integrally rotatable with the scroll wheel and is exposed to an outside of the scroll wheel to enable the operator to directly and visually recognize a portion of the ring member projecting outward from the opening, the ring member being formed by a light transmissive member, which is configured to transmit light;

a light source that is configured to generate the light for nighttime illumination;

a wheel illumination light guide member that is configured to guide the light, which is outputted from the light source, to the scroll wheel; and a metal film that is formed at an inner peripheral surface of the ring member.

2. The operation device according to claim 1, comprising a nonwoven fabric that is installed to an adjacent portion, which is adjacent to the opening and is located on an inner side of the operation surface, while the nonwoven fabric is configured to contact the scroll wheel, wherein:

the nonwoven fabric is installed in a state where the nonwoven fabric is sagging.

3. The operation device according to claim 1, comprising:

a rotational direction indicator that is placed adjacent to the scroll wheel; and a rotational direction illumination light guide member that is configured to guide the light, which is outputted from the light source, to the rotational direction indicator.

4. The operation device according to claim 1, wherein:

the ring member is made of resin; and a paint, which diffuses the light, is printed to a portion of the ring member that has a gate trace, which is a trace of a gate of a resin molding die used for molding the ring member.

5. The operation device according to claim 3, wherein a black color paint is printed at a side surface of the wheel illumination light guide member and a side surface of the rotational direction illumination light guide member, which are opposed to each other.

* * * * *